United States Patent [19]

Kataoka

[11] 4,239,001

[45] Dec. 16, 1980

[54] MULTICOLOR ROTOGRAVURE PRINTING SYSTEM

[76] Inventor: Hiroshi Kataoka, 5-8, Asahi 1-chome, Iyomishimak-shi, Ehime-ken, Japan

[21] Appl. No.: 19,834

[22] Filed: Mar. 12, 1979

Related U.S. Application Data

[63] Continuation-in-part of Ser. No. 871,632, Jan. 23, 1978, abandoned.

[30] Foreign Application Priority Data

Sep. 14, 1977 [JP] Japan ..... 52-109927

[51] Int. Cl.[3] ..... B41F 9/02; B41F 9/18; B41F 13/40

[52] U.S. Cl. ..... 101/152; 101/181; 101/182; 101/247; 101/351

[58] Field of Search ..... 101/152, 153, 154, 178, 101/155–157, 181, 180, 179, 216, 219, 247, 182, 185, 350, 351

[56] References Cited

U.S. PATENT DOCUMENTS

| | | | |
|---|---|---|---|
| 2,506,011 | 5/1950 | Caulfield | 101/153 |
| 3,173,360 | 3/1965 | Hamilton | 101/178 |
| 3,173,361 | 3/1965 | Verlik | 101/216 |
| 3,384,012 | 5/1968 | Zernov | 101/216 |
| 3,613,577 | 10/1971 | Halley | 101/152 X |
| 3,625,145 | 12/1971 | Heatley, Jr. | 101/152 |
| 3,783,782 | 1/1974 | Hardt | 101/216 |
| 3,876,087 | 4/1975 | Osta | 101/216 |
| 4,046,070 | 9/1977 | Halley | 101/153 X |
| 4,137,843 | 2/1979 | Ottenhue | 101/153 |

FOREIGN PATENT DOCUMENTS

| | | | |
|---|---|---|---|
| 1003887 | 9/1965 | United Kingdom | 101/178 |

*Primary Examiner*—J. Reed Fisher
*Attorney, Agent, or Firm*—Kurt Kelman

[57] ABSTRACT

A multicolor rotogravure printing system comprising a train of as many monochromatic printing units as the number of the colors required, each printing unit comprising an upper structure including an impression roll and a lower structure including a plate cylinder. These upper and lower structures are adapted to connect and disconnect from each other, and the upper structures are fixed to and suspended from a main frame. Each lower structure has a moving means, thus making it easy to change a used lower structure for a fresh one, and at the same time to perform necessary adjustment of those parts of the printing unit which are made accessible by removal of the lower structure. Also, the length of idle time in printing operation is appreciably reduced.

6 Claims, 9 Drawing Figures

MULTICOLOR ROTOGRAVURE PRINTING SYSTEM

REFERENCE TO COPENDING APPLICATION

This application is a continuation-in-part of my copending application Ser. No. 871,632, now abandoned, filed Jan. 23, 1978.

BACKGROUND OF THE INVENTION

This invention relates to a multicolor gravure rotary press comprising a train of monochromatic printing units each allotted for performing a different color printing on an elongated sheet. More specifically, this invention relates to a multicolor gravure rotary press comprising a train of monochromatic printing units each consisting of an upper structure including an impression roll and a lower structure including a plate cylinder and an ink device, each said upper structure being integrally connected to and suspended from a main frame the end legs of which at the opposite extremes with respect to the sheet-feeding direction are fixed to the floor of the shop, and each said lower structure when raised, being brought into fast union with the associated upper structure.

The most commonly used conventional multicolor gravure rotary press consists of a train of individual printing units each allotted for performing a different color printing, thereby finally causing multicolored patterns to appear on a sheet in the form of multicolor combinations. These individual printing units are separate from each other and each is fixed to the floor of the shop.

With a view to facilitating the work of changing printing plates, the entire plate cylinder bearing the printing plate is ordinarily detached from the body of printing unit, and then another plate cylinder prepared in advance is inserted into the printing unit. Thus, the time required for completion of the printing work is accordingly shortened.

In moving and changing the plate cylinder a carrier is ordinarily used because of the relatively heavy weight of the plate cylinder.

Sometimes a carrier is integrally connected with the body of the plate cylinder. In a still better arrangement, the plate cylinder, the ink device and other auxiliary parts are built into the carrier. These arrangements make it easy to replace the printing plate, and at the same time advantageously give the operator plenty of time to clean the printing plate and to adjust the various parts of the plate cylinder after it has been detached from the printing unit. The combination of the carrier and the printing cylinder makes it easier to remove the plate cylinder than the use of a separate carrier. There has, however, been no reliable and easy means for bringing the carrier-and-plate cylinder assembly into engagement with the main frame to which the impression roll is fixed. One attempt in this direction has been the provision of a revolving turret, a component which itself is entirely unnecessary for a printing machine. This turret is provided on the main frame which supports the impression cylinder. A carrier bearing a plate cylinder is placed on the turret, and then the turret is rotated to bring the carrier into a position at which the printing cylinder is aligned to and in contact with the impression roll, thereby making the printing machine ready for operation. This arrangement makes it easy to align the plate cylinder-and-carrier assembly with the impression roll, but still requires laborious work in attaching and detaching the plate cylinder from the printing unit.

As is readily understood from the above, the cost of the conventional multicolor printing machine comprising a train of separate monochromatic printing units, will increase with the number of different colors to be printed, and also, disadvantageously, the conventional multicolor printing machine requires laborious and time-consuming work in changing the printing plates. With the conventional printing machine it is practially impossible to shorten the amount of idle time or reduce the amount of work involved in the printing operation.

One object of this invention is to provide a rotogravure printing system which has a structure so simple as to permit the reduction of installation cost and which, at the same time, permits easy replacement of the printing cylinder so as to improve the working efficiency of the printing machine.

Another object of this invention is to provide a rotogravure printing system of a structure which makes it possible to replace a used plate cylinder with a standby in a very short time and also permits mechanized transport of plate cylinders by use of guide tracks on the floor of the shop.

SUMMARY OF THE INVENTION

To attain the objects mentioned above, a multicolor rotogravure printing system according to this invention comprises: a main frame standing on legs at its opposite ends; a plurality of upper structures spaced from each other fixed to and suspended from the main frame, each upper structure having female positioner recesses on its lower major surface; a corresponding plurality of lower structures each having a plate cylinder, male positioner pins to fit into the female positioner recesses of the upper structure when brought into fast union, and a carrier means on its lower major surface; and a vertical motion means for raising the lower structure when brought into the position in which the male positioner pins of the lower structure are alligned with the female positioner recesses of the upper structure. According to this invention there are provided a train of printing units each having upper and lower structures, the upper structures being suspended from the common frame thereby eliminating the need for printing unit stands and integrating the component printing units into a single and simple structure. Each lower structure is provided with a plate cylinder and can be easily detached from the upper structure of the component printing unit simply by causing the vertical motion means to lower the lower structure. In the lowered state the used printing plate on the plate cylinder can be easily changed and various parts of the plate cylinder can be easily adjusted. Use of a stand-by lower structure reading to take the position of the used one makes it possible to minimize the length of time for changing the printing plate, and accordingly improves the working efficiency of the printing machine. Also, use of guide tracks provided in the floor of the shop to extend under each printing unit makes it possible to replace and clean the printing plates in such an effective and systematic way that the printing operation can be performed at an increased efficiency. Further provision of means for driving movable lower structures on the guide tracks and of electronic and computer systems for controlling such driving means will permit fully automatic, unmanned operation.

The other objects and characteristic features of the present invention will become apparent from the description of the invention to be given in detail hereinafter with reference to the accompanying drawing.

DESCRIPTION OF THE PREFERRED EMBODIMENTS

Figure 1:
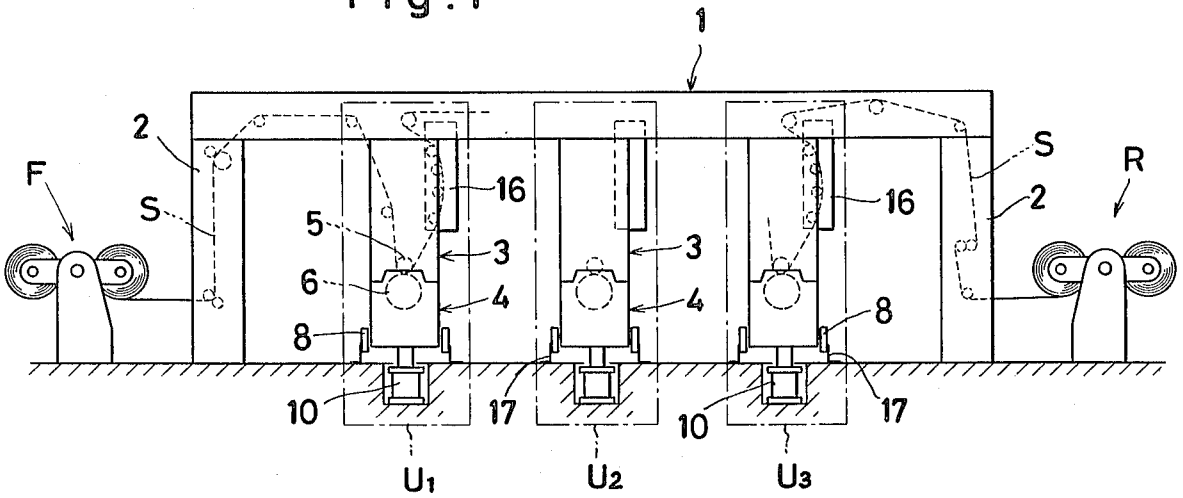
FIG. 1 is a side elevation of one preferred embodiment of the printing system according to the present invention as applied to gravure printing.
Figure 2:
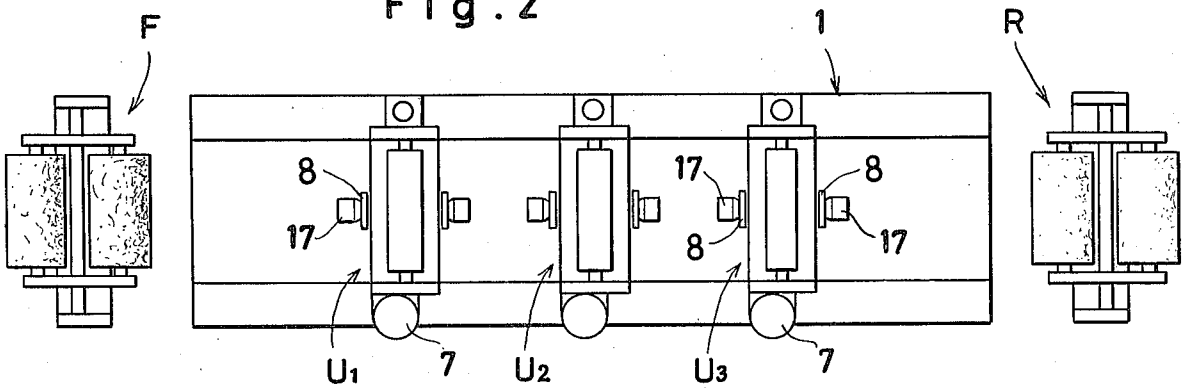
FIG. 2 is a plan view of the printing system of FIG. 1.
Figure 4:
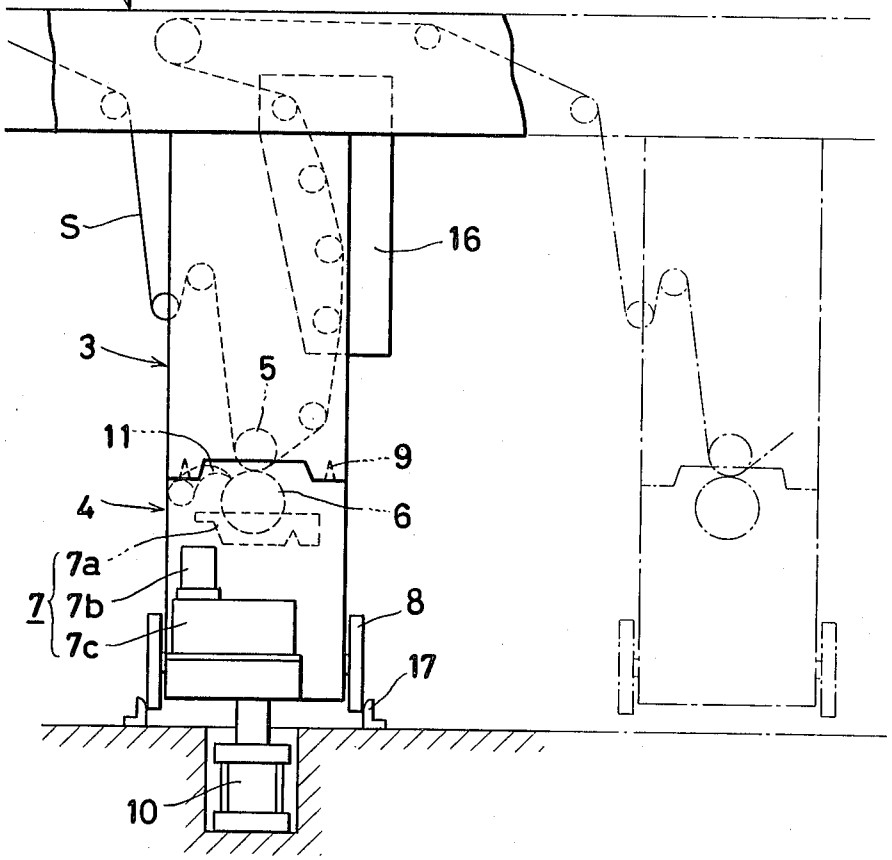
FIGS. 3 and 4 are side views of a printing unit of the printing system with the upper and lower structures, in the disconnected and connected states.

Referring to FIGS. 1 and 2, there is shown one embodiment of a multicolor rotogravure press according to this invention. As shown, the printing machine comprises a train of component monochromatic printing units $U_1$, $U_2$ and $U_3$ each performing a different color printing. There are provided as many component printing units as the number of colors required in printing, and usually three or more component printing units are used. A continuous length of sheet S from a feeder F runs over the guide rolls and between the impression rolls 5 and the plate cylinders 6 of the component printing units. After passing between the impression roll and plate cylinder of one component printing unit and after being printed in the color allotted to that component unit, the sheet runs through a drier 16 before reaching the subsequent printing unit. After passing through all the component printing units one after another, and after being multicolor printed, the sheet is rolled on a rewinder R.

Figure 3:
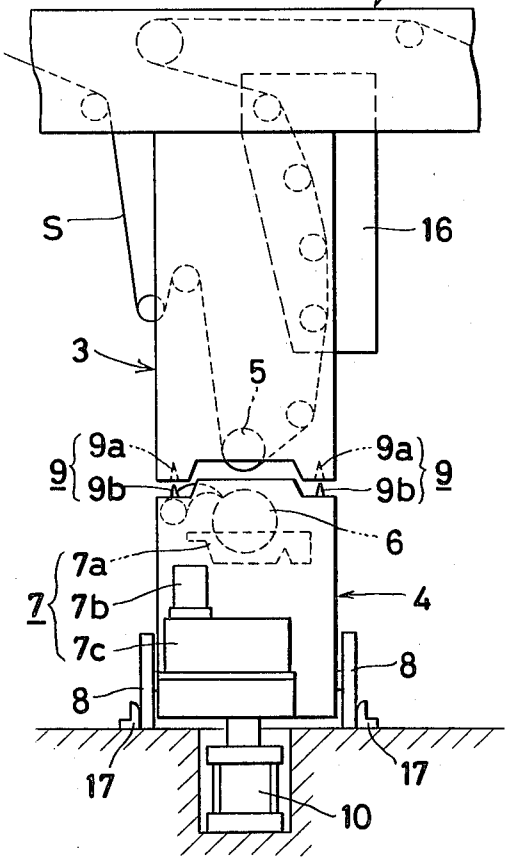
Figure 5:
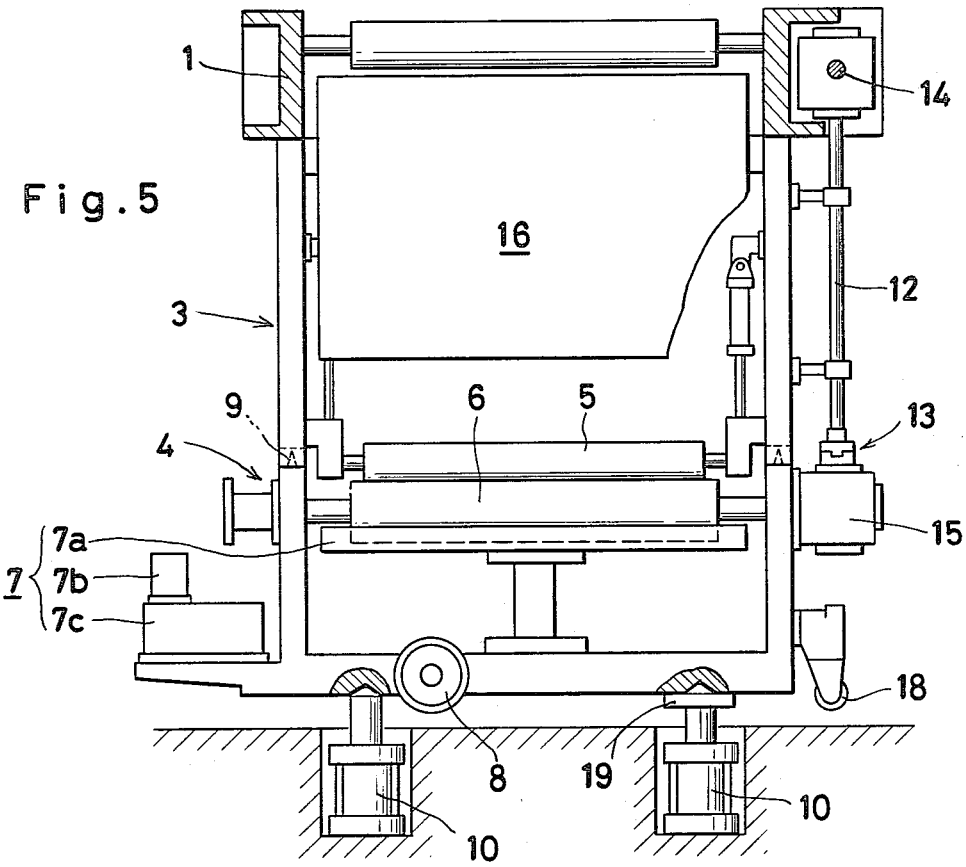
FIG. 5 is a partial front view of the component printing unit of FIG. 4.

As mentioned earlier, the conventional multicolor printing machine comprises a train of separate printing units (for instance, four component printing units for four color printing) each having a stand to support the whole body of the component unit on the floor of the shop. In one aspect of a multicolor printing system according to this invention, each component printing unit comprises a stationary part (upper structure 3) and a movable part (lower structure 4), and the stationary part is fixed to and suspended from a common frame whose opposite end legs 2 are fixed to the floor of the shop, thus integrating all the component printing units in a sturdy and simple structure. FIG. 3 shows a component printing unit. As shown, the upper structure 3 consists of an impression roll 5, a drier 16 and other parts which require no movement in the replacement of the printing plate or adjustment of the machine. The upper structure is fixed to and suspended from the common frame 1 whose opposite end legs 2 are fixed to the floor of the shop. The lower structure 4 consists of a plate cylinder 6 with a printing plate thereon, an inking device 7 and other parts which requiring regular replacement or adjustment. The lower structure consitutes a movable and separable component, thus making it easy to replace the printing plate and adjust various parts of the component unit. Specifically, a stand-by lower structure is provided in a state ready to take the place of the used one, thereby reducing the length of idle or rest time in printing work, and at the same time eliminating a great part of the laborious work involved in replacing printing plates. Wheels 8 are provided on the opposite sides of the lower structure frame as a means for allowing the lower structure to readily move. As shown in FIG. 5, a universal wheel 18 is advantageously provided to allow the lower structure to move in all directions. This extra wheel also makes the lower structure stable in movement.

The printing unit is formed by bringing the lower structure 4 into fast union with the upper structure 3. This union of the two structures is accomplished by the lower structure 4 being pushed up by vertical motion means 10 such as, for example, a hydraulic cylinder which is disposed below or on the floor of the shop. To ensure exact registration between the two structures thus brought into fast union, the structures are provided with complimentary positioner means 9 (FIG. 3) which comprise, for example, male positioner pins **9*b* disposed at two or more positions on the upper surface of the framework of the lower structure and as many female positioner recesses 9*a* for receiving the male positioner pins disposed at corresponding positions on the lower surface of the framework of the upper structure. On the floor surface there are provided position indicators 17 whose function is to hold moving means 8 in such a position that it will permit the lower structure 4 which becomes horizontally movable on the floor surface after detachment from the printing unit to be brought to the exact position directly below the upper structure 3 prior to reunion of the two structures. To permit required separation of the printing unit into the upper and lower structures, the driving shaft 12 serving to convey a rotational motion required to keep the plate cylinder 6 in motion incorporates a coupling 13 adapted so that the coupling 13 is brought into its meshed condition only when the lower structure 4 pushed up by the vertical motion means 10 is brought into perfect engagement with the upper structure 3. Through the medium of this meshed engagement, the rotational motion caused by the line shaft 14 is conveyed through the driving shaft 12 and the gear box 15** to the plate cylinder.

Owing to the aforementioned construction in which the printing unit is formed, the lower structure 4 which is made up of the members involved in the printing operation can be separated from the stationary upper structure 3 which is made up of the members involved in the paper feeding operation. In the rotogravure printing system illustrated as a typical example adopting this construction, an inking device 7 made up of an ink bar **7*a*, an ink pump 7*b* and an ink tank 7*c*, and a doctor 11 serving to remove the applied ink from the printing surface are the component members of the lower structure 4 in addition to plate cylinder 6**. Separation of the lower structure from the printing unit renders the work of inspection, repair and adjustment of these component members decisively easier to accomplish.

In the illustrated embodiment, there are provided two sets of vertical motion means 10 which impart a vertical motion to the lower structure 4. Since they are disposed parallel to the direction of the width of the printing unit, there is a possibility that the lower structure while in vertical motion will be inclined in the lateral direction. To preclude this possibility, a receiver plate 19 of a suitable size is disposed at the upper end of the shaft of one of the two sets of the vertical motion means. Of course, use of only one set of vertical motion means may suffice, depending on the conditions of the printing operation. In this case, the receiver plate may be in the shape of a disk and may be applied to the gravitational center of the lower structure.

Further for the purpose of facilitating the horizontal motion of the lower structure which has been separated from the printing unit in the present embodiment, a pair of moving means 8 are disposed one each on the opposite sides of the framework of the lower structure and a caster 18 is disposed at one end of the framework. The cooperation of moving means 8 and caster 18 facilitates the determination of the direction in which the lower structure is moved.

Figure 6:
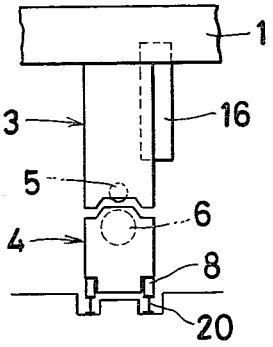
FIG. 6 is a partial explanatory diagram illustrating another preferred embodiment of the printing system according to the present invention.

Alternatively, two pairs of moving means such as wheels are disposed, like the wheels in an automobile, on the opposite ends of the framework of the lower structure 4 and a pair of wheel guide tracks 20 such as, for example, rails are laid on the floor surface as illustrated in FIG. 6. The combination of the moving means with the guide tracks not merely facilitates the positioning of the lower structure relative to the upper structure but also permits the printing operation such as is illustrated, for example, to be managed both systematically and efficiently.

Figure 7:
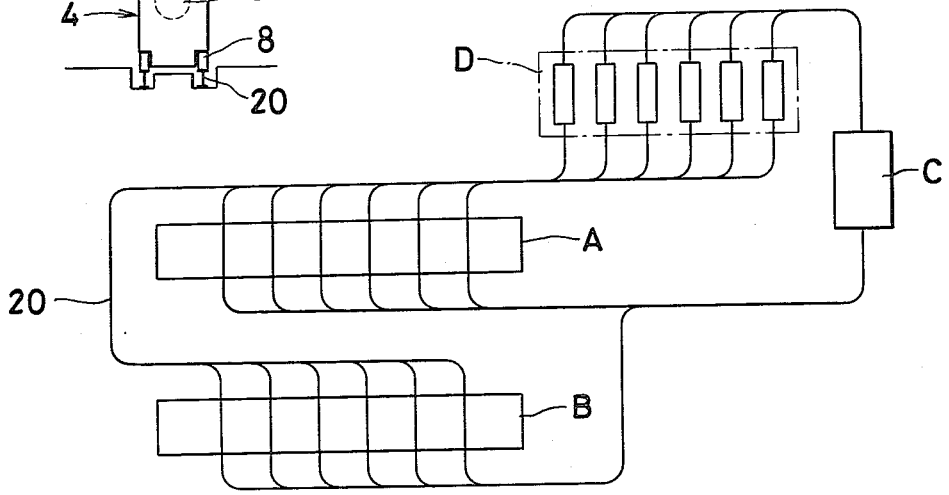
FIG. 7 is a system diagram illustrating a typical case wherein standbys of lower structures in the component printing unit of the printing system of this invention are used.

The preferred embodiment illustrated in FIG. 7 represents a plant composed of two parallel printing systems A and B each consisting of six printing units. A printing surface washing area C and a waiting area D for standby lower structures can be effectively combined with the printing systems A and B through the medium of wheel guide tracks. If the printing process is programmed in advance, then the standby lower structures having fresh printing plates mounted in position thereon can be prepared ready for change with those lower structures in use as soon as one printing operation is completed. This ready change of lower structures serves the purpose of notably shortening the time required for change of printing surfaces. The work of inspection and adjustment of parts in the detached lower structures can be carried out without interrupting the operation of the entire printing plant.

Figure 8:
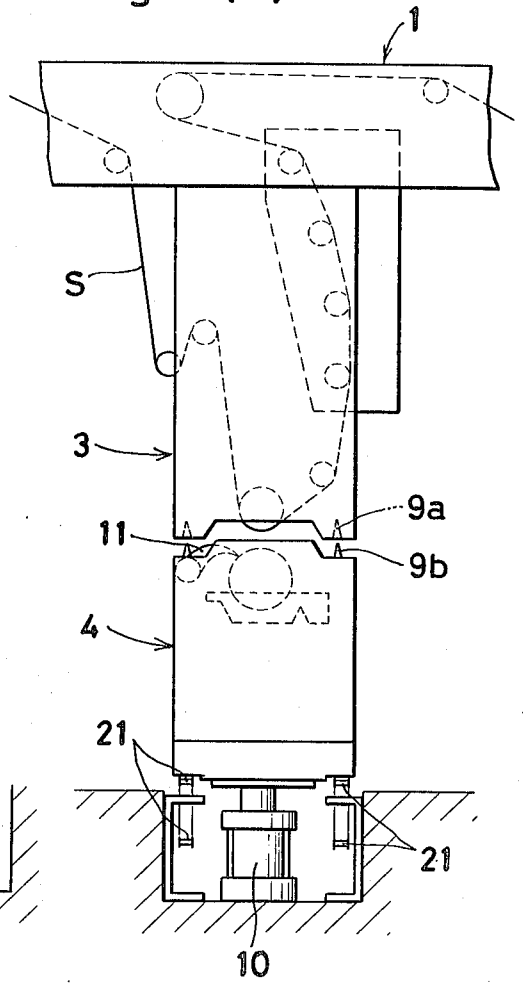
FIGS. 8A and 8B are, respectively, front and side views of one modification of the printing system which permits the automatic positioning of the lower structure under the upper structure of a component printing unit.
Figure 8:
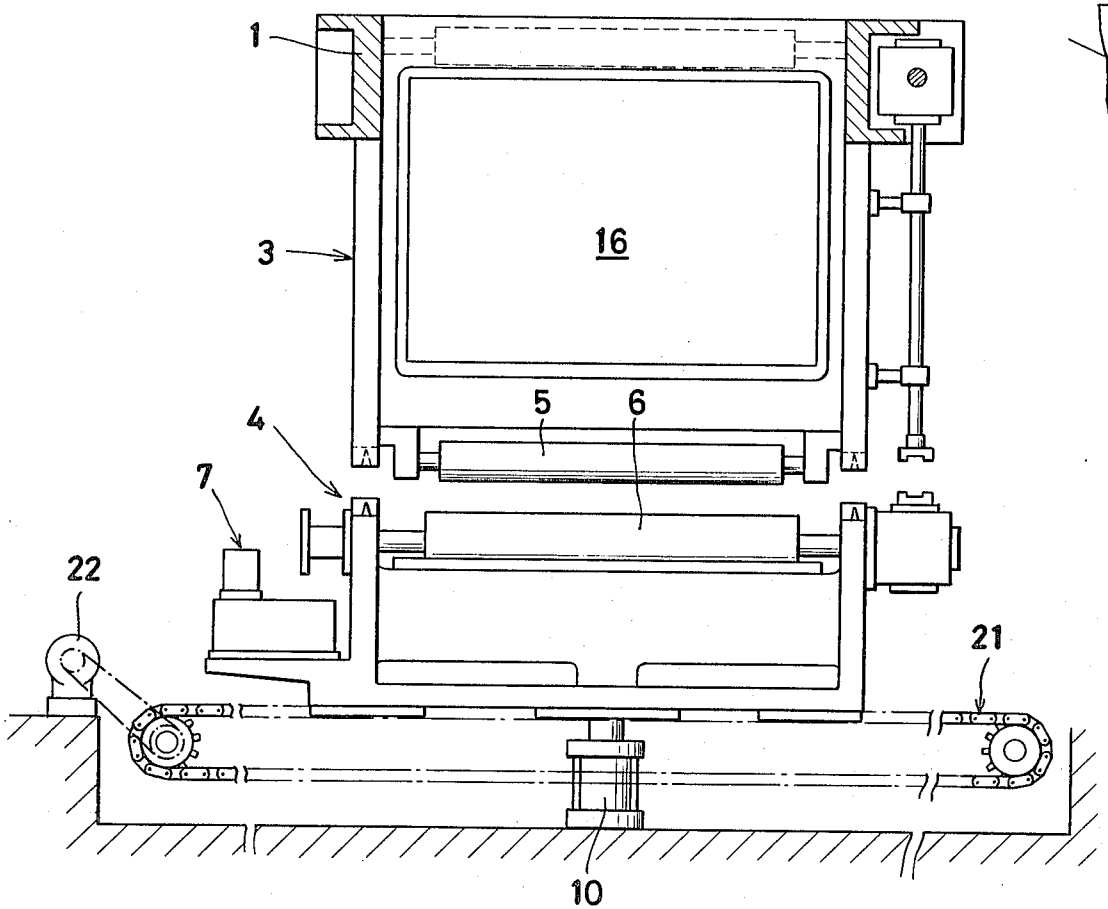

In the future there will no doubt be a trend toward automation of all the miscellaneous jobs related to printing machine operation. The structure of the printing machine according to this invention is well adapted to this type of automation. For example, the printing machine can be more fully automated by incorporating into the lower-structure a self-driving means controllable from a remote location. This, however, will increase the size of the lower structure, and accordingly increase the difficulty of carrying out the control. As a remedy to this problem, as shown in FIGS. 8A and 8B, a conveyor means 21 is installed crosswise under each component printing unit on or in the floor of the shop, and then any one of the lower structures can be automatically separated and shifted out from under the associated upper structure by controlling the vertical motion means 10 and then a driving motor 22 associated with the crosswise conveyor. The embodiment shown in FIGS. 8A and 8B uses an endless chain conveyor, but this should not be understood as limitative, and any other structure which meets the practical requirements can be also used. Also, as shown in FIG. 8A, the conveyor is extended at opposite sides by a length great enough to allow the full length of the lower structure to be displaced from under the upper structure. In operation, a stand-by lower structure is stationed on one of the opposite extensions. The used lower structure is lowered and put on the conveyor, and then it is shifted to the other extension, and at the same time the stand-by lower structure is shifted to the proper position just under the associated upper structure. By this method, the replacement of the lower structure can be readily performed. With this arrangement and other necessary installations fully automatic unmanned printing work can be realized. In an alternative arrangement, a conveyor means can be integrally connected to the lower structure and a length of cable can be used in place of the endless chain for pulling and shifting the lower structure.

As is apparent from the above, the multicolor rotogravure printing system according to this invention greatly reduces the time and work required for changing the used printing plates and for performing necessary adjustments. Moreover, the system can be optionally provided with conveyor means for removal and insertion of the lower structures so that when combined with an electronic computer system for controlling the conveyor means and other peripheral equipment, fully automatic, unmanned printing operation can be realized.

What is claimed is:

1. A multicolor rotogravure printing system comprising (a) a main frame comprised essentially of an elongated support beam means having two ends and of sufficient length to accommodate a plurality of printing stations side-by-side, and two legs fixedly supporting the support beam means at the two ends;

(b) a rotary main drive shaft extending over the length of the support beam means for providing rotational motion; and (c) a monochromatic printing unit at each one of the printing stations, each printing unit including (1) an upper structure having a lower surface, the upper structure being fixedly suspended from the elongated support beam means of the main frame and comprising an impression roll mounted at a fixed distance from the beam means, a drier, a series of sheet guide rollers, a first positioner means on the lower surface of the upper structure, and a vertical drive shaft having one end coupled to the main drive shaft and receiving the rotational motion therefrom and an opposite end carrying one half of a coupling, (2) a movable lower structure having an upper surface and comprising a plate cylinder having a rotatable axle, a gear box at an end of the plate cylinder axle, the gear box including the other half of the coupling, the coupling halves being complementary and being engageable with each other for transmitting the rotational motion to the plate cylinder axle, an inking device, wheels for moving the lower structure away from the upper structure, and second positioner means on the upper surface of the lower structure, the first and second positioner means being complementary, and (3) vertical motion means mounted at each printing station below the lower structure and arranged for raising the lower structure into engagement with the upper structure, said engagement including engagement of the first and second positioner means and of the coupling halves whereby the printing system is put in condition for operation upon moving the lower structure into the printing station and actuating the vertical motion means.

2. The multicolor rotogravure printing system of claim 1, further comprising a plate cylinder cleaning station, a lower structure stand-by station and guide tracks for the wheels of the lower structures, the guide tracks interconnecting the printing stations, the cleaning station and the stand-by station for moving the lower structures between the stations.

3. The multicolor rotogravure printing system of claim 1, wherein one of the positioner means is a male pin and the other positioner means is a complementary female recess.

4. The multicolor rotogravure printing system of claim 1, further comprising a conveyor means mounted at each printing station below the lower structure for moving the lower structure away from the upper structure after actuation of the vertical motion means to disengage the lower and upper structures from each other, the conveyor means extending transversely to the printing station to opposite sides thereof and having a length sufficient to allow the full length of the lower structure to be displaced in relation to the upper structure.

5. The multicolor rotogravure printing system of claim 4, wherein the conveyor means comprises an endless chain.

6. The multicolor rotogravure printing system of claim 4, comprising a stand-by movable lower structure in a state ready to take the place of a used lower structure in one of the printing stations, the stand-by lower structure being placed on the conveyor means on one side thereof and operation of the conveyor means moving the stand-by lower structure into alignment with the upper structure in the printing station while moving the used lower structure to the opposite side.

* * * * *